US010018927B2

(12) United States Patent
Yamada et al.

(10) Patent No.: US 10,018,927 B2
(45) **Date of Patent: *Jul. 10, 2018**

(54) ELECTROCONDUCTIVE MEMBER FOR ELECTROPHOTOGRAPHY, PROCESS CARTRIDGE AND ELECTROPHOTOGRAPHIC APPARATUS

(71) Applicant: CANON KABUSHIKI KAISHA, Tokyo (JP)

(72) Inventors: Satoru Yamada, Numazu (JP); Kazuhiro Yamauchi, Suntou-gun (JP); Norifumi Muranaka, Yokohama (JP); Tetsuo Hino, Yamato (JP); Yuichi Kikuchi, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 527 days.

This patent is subject to a terminal disclaimer.

(21) Appl. No.: 14/666,252

(22) Filed: Mar. 23, 2015

(65) Prior Publication Data

US 2015/0198900 A1 Jul. 16, 2015

Related U.S. Application Data

(63) Continuation of application No. PCT/JP2014/004872, filed on Sep. 24, 2014.

(30) Foreign Application Priority Data

Sep. 27, 2013 (JP) ..... 2013-202661

(51) Int. Cl.
*G03G 5/00* (2006.01)
*H01B 1/20* (2006.01)
(Continued)

(52) U.S. Cl.
CPC ..... *G03G 5/00* (2013.01); *G03G 15/0233* (2013.01); *H01B 1/20* (2013.01); *H01B 5/02* (2013.01); *G03G 2215/00957* (2013.01)

(58) Field of Classification Search
CPC ..... G03G 5/00; G03G 15/0233; G03G 2215/00957; H01B 1/20; H01B 5/02
See application file for complete search history.

(56) References Cited

U.S. PATENT DOCUMENTS 4,950,529 A * 8/1990 Ikeda ..... B01D 39/1623 428/419
8,149,463 B2 4/2012 Kawamura
(Continued)

FOREIGN PATENT DOCUMENTS

CN 101415062 4/2009
JP 8-272187 A 10/1996
(Continued)

OTHER PUBLICATIONS

U.S. Appl. No. 14/709,155, filed May 11, 2015. Inventor: Satoru Nishioka, et al.
(Continued)

*Primary Examiner* — Jeremy R Pierce
(74) *Attorney, Agent, or Firm* — Fitzpatrick Cella Harper and Scinto

(57) ABSTRACT

An electroconductive member of the present invention includes an electroconductive support layer and a surface layer formed on the circumference of the electroconductive support layer and having a network structure containing an electroconductive fiber, and the electroconductive fiber has ion conductivity, and has an arithmetic mean value of top 10% fiber diameters of 0.2 μm or more and 15.0 μm or less. The surface layer always satisfies specific conditions.

10 Claims, 4 Drawing Sheets

(51) Int. Cl.
*H01B 5/02* (2006.01)
*G03G 15/02* (2006.01)

(56) References Cited

U.S. PATENT DOCUMENTS

| | | | | |
|---|---|---|---|---|
| 8,298,670 | B2 | 10/2012 | Muranaka et al. | |
| 8,422,906 | B2 | 4/2013 | Komiyama et al. | |
| 8,449,975 | B2 | 5/2013 | Hirakoso et al. | |
| 8,628,854 | B2 | 1/2014 | Yamauchi et al. | |
| 8,668,987 | B2 | 3/2014 | Yamauchi et al. | |
| 8,715,830 | B2 | 5/2014 | Yamada et al. | |
| 8,771,818 | B2 | 7/2014 | Nishioka et al. | |
| 8,852,743 | B2 | 10/2014 | Kikuchi et al. | |
| 9,023,465 | B2 | 5/2015 | Yamada et al. | |
| 9,547,250 | B2 * | 1/2017 | Kikuchi | G03G 15/0233 |
| 9,551,949 | B2 * | 1/2017 | Yamauchi | G03G 15/0233 |
| 2007/0280749 | A1 * | 12/2007 | Sawai | G03G 15/1605 399/302 |
| 2010/0193999 | A1 * | 8/2010 | Anneaux | D01D 5/0038 264/438 |
| 2011/0025752 | A1 * | 2/2011 | Law | B41J 13/076 347/20 |
| 2012/0263499 | A1 * | 10/2012 | Yamauchi | G03G 15/0233 399/176 |
| 2013/0281276 | A1 | 10/2013 | Watanabe et al. | |
| 2014/0154512 | A1 * | 6/2014 | Dooley | G03G 15/2057 428/411.1 |
| 2014/0178096 | A1 | 6/2014 | Yamauchi et al. | |
| 2014/0221184 | A1 | 8/2014 | Arimura et al. | |
| 2014/0287899 | A1 | 9/2014 | Nishioka et al. | |
| 2015/0093151 | A1 | 4/2015 | Muranaka et al. | |
| 2015/0132024 | A1 | 5/2015 | Watanabe et al. | |
| 2015/0198904 | A1 | 7/2015 | Kikuchi et al. | |
| 2015/0198905 | A1 | 7/2015 | Kikuchi et al. | |
| 2015/0198906 | A1 | 7/2015 | Yamauchi et al. | |

FOREIGN PATENT DOCUMENTS

| | | | |
|---|---|---|---|
| JP | 2002-268332 | A | 9/2002 |
| JP | 2004-117783 | A | 4/2004 |
| JP | 2009-300849 | A | 12/2009 |
| JP | 2011-123387 | A | 6/2011 |
| JP | 2012-212127 | A | 11/2012 |

OTHER PUBLICATIONS

U.S. Appl. No. 14/708,940, filed May 11, 2015. Inventor: Masaki Yamada, et al.

U.S. Appl. No. 14/715,477, filed May 18, 2015. Inventor: Sosuke Yamaguchi, et al.

International Search Report dated Nov. 11, 2014 in International Application No. PCT/JP2014/004872.

International Preliminary Report on Patentability, International Application No. PCT/JP2014/004872, dated Apr. 7, 2016.

* cited by examiner

ELECTROCONDUCTIVE MEMBER FOR ELECTROPHOTOGRAPHY, PROCESS CARTRIDGE AND ELECTROPHOTOGRAPHIC APPARATUS

CROSS-REFERENCE TO RELATED APPLICATIONS

This application is a continuation of International Application No. PCT/JP2014/004872, filed Sep. 24, 2014, which claims the benefit of Japanese Patent Application No. 2013-202661, filed Sep. 27, 2013.

BACKGROUND OF THE INVENTION

Field of the Invention

The present invention relates to an electroconductive member for electrophotography, a process cartridge and an electrophotographic apparatus.

Description of the Related Art

In an electrophotographic apparatus, that is, an image forming apparatus employing an electrophotographic method, electroconductive members are used for various purposes. For example, such members are used as a charging roller, a developing roller and a transfer roller. It is necessary to control the electrical resistance value of such an electroconductive member used in an electrophotographic apparatus to be $10^3$ to $10^{10}\Omega$. For this purpose, an electron conducting agent represented by carbon black or an ion conducting agent such as a quaternary ammonium salt compound is incorporated into the electroconductive member.

An electron conducting agent such as carbon black is used as a conducting agent for various electroconductive members because the electrical resistance value is not affected by use environments such as a temperature and a humidity. It is known, however, that if an electroconductive member is provided with conductivity by using an electron conducting agent such as carbon black, there is a possibility that non-uniformity in the electrical resistance value may be caused due to non-uniform dispersion of the electron conducting agent. In particular, it is extremely difficult to prevent sites having a lower electrical resistance value from occurring locally in the electroconductive member due to aggregation of the electron conducting agent.

On the other hand, if an ion conducting agent is incorporated into an electroconductive member, the ion conducting agent is dispersed at the molecular size level, and hence, the non-uniformity in the electrical resistance value can be reduced as compared with the case where an electron conducting agent is used. The resultant electroconductive member has, however, a disadvantage that the electrical resistance value is largely varied depending on the temperature and the humidity of the use environment. In particular, under a low-temperature and low-humidity environment of a temperature of 15° C. and a relative humidity of 10% (hereinafter sometimes referred to as "under the L/L environment"), the electrical resistance value may become high due to drying of the electroconductive member in some cases.

Japanese Patent Application Laid-Open No. H08-272187 proposes a charging member having on an electroconductive substrate an entangled material of electroconductive fiber provided with an electron conjugated polymer. This charging member is free from the non-uniformity in the electrical resistance and shows stable conductivity, and hence, can uniformly electrically charge an electrophotographic photosensitive member as a body to be charged.

SUMMARY OF THE INVENTION

A charging roller is disposed in contact with a photosensitive drum in an electrophotographic apparatus so as to perform electric charging of the photosensitive drum with a DC voltage. The charging roller may be often controlled for the electrical resistance value thereof with the aid of an electron conducting agent such as carbon black. If an electron conducting agent is used, however, an abnormal discharge having an excessive discharge charge amount may occur in a portion having a lower electrical resistance value caused by the aggregation of the electron conducting agent, and this abnormal discharge may lead to a blank area or spot formed in resultant images.

Since the charging roller may be dried to have a higher electrical resistance value under the L/L environment, a weak discharge may be liable to be intermittently caused, which may cause a horizontal streak-like image failure in some cases. Particularly when an ion conducting agent is used, it is known that the electrical resistance value of the charging roller is largely varied according to the water content of the charging roller, and as a result, there is a high possibility that a horizontal streak-like image failure is caused under the L/L environment.

With respect to a transfer roller, that is, another application example of the electroconductive member, similarly to the charging roller, a site having a lower electrical resistance value may occur locally in the transfer roller due to the non-uniform dispersion of a conducting agent, or the electrical resistance value may be deviated from a proper region of the resistance depending on the use environment, and as a result, an abnormal transfer image may be formed.

Thus, for an electroconductive member for electrophotography, such as a charging roller or a transfer roller, it is necessary to achieve both reduction of the non-uniformity in the electrical resistance value of the electroconductive member due to the non-uniform dispersion of the conducting agent and inhibition of the variation in the electrical resistance value of the electroconductive member due to the use environment. Under the current circumstances where an electrophotographic apparatus is required of a higher speed and a longer life, however, there is a tendency that the proper region of the electrical resistance value or available types of conducting agents, for achievement of both the reduction of the non-uniformity in the resistance value and the inhibition of the variation in the resistance value, are restricted. Further, there is a possibility that it might be difficult in the future to provide an electroconductive member capable of inhibiting an image failure in controlling only the electrical resistance value of the electroconductive member.

In general, the discharge characteristics of an electroconductive member are largely affected not only by the electrical resistance value of the electroconductive member but also by the surface shape of the electroconductive member. In other words, it is known that even when the electroconductive member is of a member constitution whose desired property cannot be easily attained by merely controlling the electrical resistance value, desired discharge characteristics can be realized by controlling the surface shape of the electroconductive member.

The charging member disclosed in Japanese Patent Application Laid-Open No. H08-272187 is free from the non-uniformity in the electrical resistance value and shows stable conductivity, so that an electrophotographic photosensitive member can be uniformly charged. In an electrophotographic image forming apparatus having a higher speed and higher image quality, however, further improvement is needed.

The electroconductive member for electrophotography according to the present invention comprises: an electroconductive support layer; and a surface layer formed thereon, and the surface layer has a network structure containing electroconductive fibers, the electroconductive fibers having an ion conductivity, and having an arithmetic mean value $d^{U10}$ of top 10% fiber diameters, of 0.2 μm or more and 15.0 μm or less as measured at arbitrary 100 points in an SEM observed image of the electroconductive fibers, and the surface layer satisfies the following conditions (1) and (2):

(1) when the surface layer is observed in such a manner as to face the surface layer, one or more crossings of the electroconductive fibers are observed in a square region having a one side of 1.0 mm on the surface of the surface layer; and (2) when a Voronoi tessellation is performed with generating points, the generating points being the electroconductive fibers exposed on a cross section in a thickness direction of the surface layer, each of areas of Voronoi polygons resulting from the Voronoi tessellation is defined as S1, each of cross-sectional areas in the cross section of the electroconductive fibers as the generating points is defined as $S_2$, and a ratio "$S_1/S_2$" is calculated, an arithmetic mean value $k^{U10}$ of top 10% of the ratios is 40 or more and 160 or less.

Also, the present invention provides a process cartridge detachably mountable to a main body of an electrophotographic apparatus, and the process cartridge comprises the above-described electroconductive member.

Furthermore, the present invention provides an electrophotographic apparatus including the above-described electroconductive member.

According to the present invention, an electroconductive member having a discharge characteristic and an electrical characteristic enabling a high definition image output for a long period of time at a high speed can be obtained by controlling the surface shape of the electroconductive member. Also, according to the present invention, a process cartridge and an electrophotographic apparatus contributing to stable formation of high quality electrophotographic images can be obtained.

Further features of the present invention will become apparent from the following description of exemplary embodiments with reference to the attached drawings.

DESCRIPTION OF THE EMBODIMENTS

Figure 1:
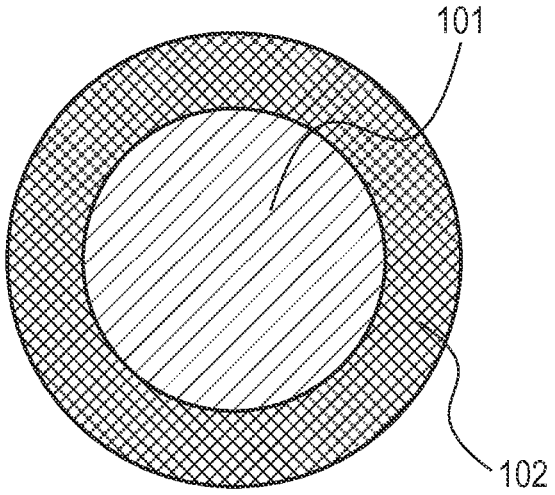
FIG. 1 is a schematic cross-sectional view of an example of an electroconductive member according to the present invention.

Preferred embodiments of the present invention will now be described in detail in accordance with the accompanying drawings.

An electroconductive member for electrophotography of the present invention includes, on an outer circumference or a surface of an electroconductive support layer, a surface layer has a network structure containing electroconductive fiber. The electroconductive fiber having an ion conductivity, and having an arithmetic mean value $d^{U10}$ of top 10% fiber diameters of 0.2 μm or more and 15.0 μm or less, as measured at arbitrary 100 points in an image observed by an SEM (scanning electron microscope) of the electroconductive fibers. The surface layer satisfies the following (1) and (2).

(1) When the surface layer is observed in such a manner as to face the surface layer, one or more crossings of the electroconductive fibers are observed in a square region having a one side length of 1.0 mm on the surface of the surface layer.

(2) When a Voronoi tessellation is performed with generating points, the generating points being the electroconductive fibers exposed on a cross section in a thickness direction of the surface layer, each of areas of the Voronoi polygons resulting from the Voronoi tessellation is defined as $S_1$, each of cross-sectional areas in the cross section of the electroconductive fibers as the generating points of the respective Voronoi polygons is defined as $S_2$, and a ratio "$S_1/S_2$" is calculated, an arithmetic mean value $k^{U10}$ of top 10% of the ratios is 40 or more and 160 or less.

The electroconductive member of the present invention can be used as an electroconductive member included in an image forming apparatus (an electrophotographic apparatus) employing the electrophotographic process (the electrophotographic method) such as a copying machine or a laser printer. Specifically, the electroconductive member can be used as a charging member, a developing member, a transferring member, a discharging member, or a conveyance member of a paper feed roller or the like. Moreover, the electroconductive member is preferably used as a member regularly supplied with an electric current, such as a charging blade or a transfer pad.

The shape of the electroconductive member can be appropriately selected, and can be, for example, a roller shape or a belt shape. The present invention is herein sometimes described with reference to a roller-shaped electroconductive member (an electroconductive roller), particularly, a charging roller representative of the electroconductive roller, to which the present invention is not limited.

In the case where the electroconductive member of the present invention is a roller-shaped electroconductive member, the x-axis direction, the y-axis direction and the z-axis direction mean the following directions: The x-axis direction means a lengthwise direction of the roller. The y-axis direction means a tangential direction on a cross section (namely, a circular cross section) of the roller perpendicular to the x-axis. The z-axis direction means a diameter direction on the cross section of the roller perpendicular to the x-axis.

An "xy plane" means a plane perpendicular to the z-axis, and a "yz cross section" means a cross section perpendicular to the x-axis. Since a minute region on the surface of the surface layer can be regarded substantially as a plane perpendicular to the z-axis, a "square with a side of 1.0 mm on the surface of the surface layer" means a square on the "xy plane" having a side of 1.0 mm along the x-axis direction and a side of 1.0 mm along the y-axis direction.

A "thickness direction" of the electroconductive member and a "thickness direction" of the surface layer mean the z-axis direction unless otherwise specified.

Figure 2:
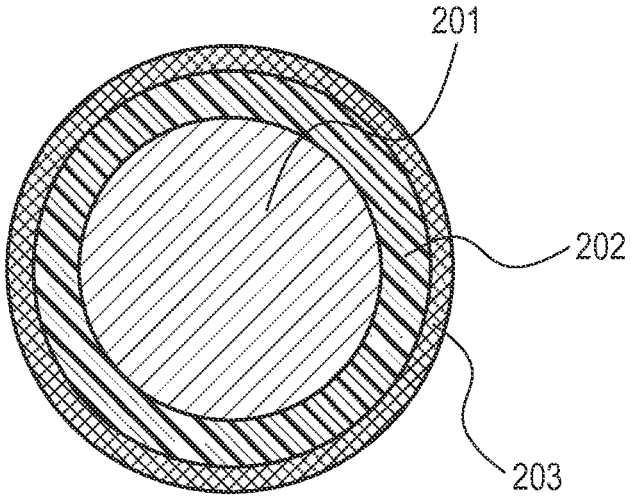
FIG. 2 is a schematic cross-sectional view of another example of the electroconductive member according to the present invention.

FIG. 1 is a schematic diagram of the cross section (the yz cross section) of a roller-shaped electroconductive member of the present invention. The electroconductive member of the present invention may include, as illustrated in FIG. 1, an electroconductive support layer 101 as a conductive substrate, and a surface layer 102 provided on the outer circumference of the electroconductive support layer 101. In this case, the surface layer 102 corresponds to the surface layer having the network structure of the present invention. In addition, the electroconductive member may include, as illustrated in FIG. 2, a conductive support layer formed of two layers 201 and 202, and a surface layer 203 provided on the circumference of the electroconductive support layer. In this manner, in the electroconductive member of the present invention, the electroconductive support layer may have a multilayered structure.

<Electroconductive Support Layer>

[Conductive Mandrel]

The electroconductive support layer has conductivity for supplying electric power to the surface layer of the electroconductive member. If the electroconductive member is in a roller shape, for example, a conductive mandrel is used. The electroconductive support layer having conductivity is, for example, a column of carbon steel alloy having, on a surface thereof, a nickel plating with a thickness of approximately 5 μm. Examples of other materials for forming the electroconductive support layer include the following: Metals such as iron, aluminum, titanium, copper and nickel; alloys including any of these metals such as stainless steel, duralumin, brass and bronze; and composite materials obtained by hardening carbon black or carbon fiber with plastics. A rigid and conductive, known material can be also used. Further, the shape of the mandrel is not limited to the columnar shape but may be a cylindrical shape having a hollow portion at the center.

[Electroconductive Resin Layer]

The electroconductive support layer can be formed into a multi-layer construction as illustrated in FIG. 2. For example, on the aforementioned conductive mandrel, an electroconductive resin layer using an elastic material of a rubber material, a resin material or the like can be formed. The rubber material is not especially limited, and any of rubbers known in the field of electroconductive members for electrophotography can be used, and specific examples include the following: An epichlorohydrin homopolymer, an epichlorohydrin-ethylene oxide copolymer, an epichlorohydrin-ethylene oxide-allyl glycidyl ether terpolymer, an acrylonitrile-butadiene copolymer, a hydrogenated product of an acrylonitrile-butadiene copolymer, silicone rubber, acrylic rubber, and urethane rubber. Also as the resin material, any resins known in the field of electroconductive members for electrophotography can be used, and specific examples include the following: An acrylic resin, polyurethane, polyamide, polyester, polyolefin, an epoxy resin, and a silicone resin. To a rubber used for forming the electroconductive resin layer, the following can be added, if necessary, for adjusting the electrical resistance value: Carbon black having electron conductivity; graphite; an oxide such as tin oxide; a metal such as copper or silver; a conductive particle provided with conductivity by coating the particle surface with an oxide or a metal; or an ion conducting agent having ion exchange performance, such as a quaternary ammonium salt or a sulfonate having ion conductivity. Further, as long as the effects of the present invention are not impaired, a generally used compounding agent for a resin, such as a filler, a softener, a processing aid, a tackifier, an anti-adhesion agent, a dispersant, a foaming agent, or a roughening particle can be added.

The volume resistivity of the electroconductive support layer of the present invention is usually $1\times10^{3}\Omega\cdot$cm or more and $1\times10^{9}\Omega\cdot$cm or less. Incidentally, it has been confirmed that a harmful effect on an image derived from an abnormal discharge having an excessive discharge charge amount can be inhibited by the surface layer having the network structure of the present invention. This effect has also been confirmed in the case where the electrical resistance value of the electroconductive support layer is sufficiently low as in, for example, a system where an electron conducting agent is dispersed. Accordingly, in consideration of the dependency of the electrical resistance value on the use environment, an electroconductive resin layer having electron conductivity can be preferably used.

<Surface Layer>

The surface layer of the electroconductive member of the present invention is a layer formed on the outer circumference or the surface of the electroconductive support layer, and has a network structure formed of electroconductive fiber.

[Electroconductive Fiber]

A material for forming the electroconductive fiber used in the present invention may be any material as long as the material has ion conductivity and can form a network structure. For example, there may be mentioned a material which is obtained by mixing a resin material, an inorganic material, having no ion conductivity, or a hybrid material of the organic material and the inorganic material with an ion conducting agent or the like, such as a quaternary ammonium salt or a sulfonate, having ion conductivity. Alternatively, instead of mixing an ion conducting agent or the like, a resin material, an inorganic material, having ion conductivity, or a hybrid material of the organic material and the inorganic material can be used.

[Resin Material]

Examples of the resin material for forming the electroconductive fiber of the present invention include the following: Polyolefin-based polymers such as polyethylene and polypropylene; polystyrene; polyimide, polyamide and polyamideimide; polyarylenes (aromatic polymers) such as polyparaphenylene oxide, poly(2,6-dimethylphenylene oxide) and polyparaphenylene sulfide; fluorine-containing polymers such as polytetrafluoroethylene and polyvinylidene fluoride; polybutadiene-based compounds; polyurethane-based compounds in the form of an elastomer and a gel; silicone-based compounds; polyvinyl chloride; polyethylene terephthalate; nylon; and polyarylate. One of these may be singly used, or a plurality of these may be used in combination, and a specific functional group may be introduced into the polymer chains, or a copolymer produced by combining two or more monomers used as starting materials for these polymers may be used.

[Ion Conducting Agent]

If these resin materials do not have ion conductivity, an ion conducting agent can be mixed with these materials. A known ion conducting agent can be used, and examples thereof include the following: Inorganic ionic materials such as lithium perchlorate, sodium perchlorate and calcium perchlorate; cationic surface active agents such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide, and modified aliphatic dimethylethyl ammonium ethosulfoate; ampholytic surface active agents such as lauryl betaine, stearyl betaine and dimethylalkyl lauryl betaine; quaternary ammonium salts such as tetraethylammonium perchlorate, tetrabutylammonium perchlorate and trimethyloctadecylammonium perchlorate; and organic acid lithium salts such as lithium trifluoromethanesulfonate. The amount of the ion conducting agent used can be 0.1 to 5 parts by mass based on 100 parts by mass of the resin material.

Further, such an ion conducting agent can be chemically bonded to the resin material. If the ion conducting agent is not chemically bonded to the resin material, the performance of charging an electrophotographic photosensitive member corresponding to a member to be charged is improved, so that the electrophotographic photosensitive member can be charged to a desired potential with a smaller amount of charge. If the ion conducting agent is not chemically bonded to the resin material, however, the ion conducting agent may excessively exude in some cases. On the contrary, if the ion conducting agent is chemically bonded to the resin material, the excessive exudation of the ion conducting agent can be prevented. As a suitable example, there may be mentioned a resin material to which, for example, a quaternary ammonium salt or a sulfonate is chemically bonded. The quaternary ammonium salt and the sulfonate can be very suitably used because the electrical resistance value of the electroconductive fiber can be set to fall in a desired range when these salts are used.

Examples of a counter ion for a quaternary ammonium group or a sulfonic acid group contained in the quaternary ammonium salt or the sulfonate include the following: Examples of the counter ion (anion) for the quaternary ammonium group include halogen ions such as a fluorine ion, a chlorine ion, a bromine ion and an iodine ion, and ionic species having structures represented by formulas (1) to (5) can be particularly suitably used. Examples of the counter ion (cation) for the sulfonic acid group include alkali metal ions such as a proton, a lithium ion, a sodium ion and a potassium ion, and ionic species having structures represented by formulas (6) to (10) can be particularly suitably used.

(1)

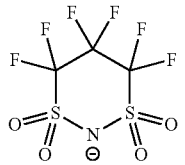

A specific example of the ion represented by formula (1) includes cyclo-hexafluoropropane-1,3-bis(sulfonyl)imide.

(2)

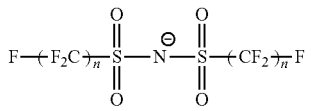

In formula (2), n represents an integer of 1 to 4. Specific examples of the ion represented by formula (2) include bis(trifluoromethylsulfonyl)imide, bis(pentafluoroethylsulfonyl)imide, bis(heptafluoropropylsulfonyl)imide and bis(nonafluorobutylsulfonyl)imide.

$$PF_6^{\ominus} \quad (3)$$

A specific example of the ion represented by formula (3) includes phosphorus hexafluoride.

$$BF_4^{\ominus} \quad (4)$$

A specific example of the ion represented by formula (4) includes boron tetrafluoride.

(5)

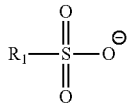

In formula (5), $R_1$ represents a hydrocarbon group having 1 to 10 carbon atoms, and may contain a hetero atom. Specific examples of a compound containing the ion represented by formula (5) include the following: Methanesulfonic acid, ethanesulfonic acid, propanesulfonic acid, butanesulfonic acid, pentanesulfonic acid, hexanesulfonic acid, heptanesulfonic acid, octanesulfonic acid, nonanesufonic acid and decanesulfonic acid.

(6)

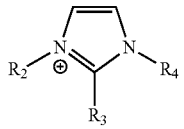

In formula (6), $R_2$, $R_3$ and $R_4$ each independently represent hydrogen or a hydrocarbon group having 1 to 10 carbon atoms, and may contain a hetero atom. Specific examples of the ion represented by formula (6) include the following: 1-methylimidazolium, 1-ethylimidazolium, 1-butylimidazolium, 1-octylimidazolium, 1-decylimidazolium, 1,3-dimethylimidazolium, 1-ethyl-3-methylimidazolium, 1-propyl-3-methylimidazolium, 1-butyl-3-methylimidazolium, 1-hexyl-3-methylimidazolium, 1-octyl-3-methylimidazolium, 1-decyl-3-methylimidazolium, 1,3-diethylimidazolium, 1-propyl-3-ethylimidazolium, 1-butyl-3-ethylimidazolium, 1-hexyl-3-ethylimidazolium, 1-octyl-3-ethylimidazolium, 1-decyl-3-ethylimidazolium, 1,2,3-trimethylimidazolium, 1-ethyl-2,3-dimethylimidazolium, 1-propyl-2,3-methylimidazolium, 1-butyl-2,3-dimethylimidazolium, 1-hexyl-2,3-dimethylimidazolium, 1-octyl-2,3-dimethylimidazolium, 1-decyl-2,3-dimethylimidazolium, and 1-butyl-3-ethylimidazolium.

(7)

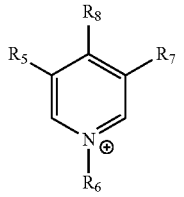

In formula (7), $R_5$, $R_6$, $R_7$ and $R_8$ each independently represent hydrogen or a hydrocarbon group having 1 to 10 carbon atoms, and may contain a hetero atom. Specific examples of the ion represented by formula (7) include the following: N-methyl pyridinium, N-ethyl pyridinium, N-butyl pyridinium, N-hexyl pyridinium, N-octyl pyridinium, N-decyl pyridinium, N-methyl-3-methyl pyridinium, N-ethyl-3-methyl pyridinium, N-butyl-3-methyl pyridinium, N-hexyl-3-methyl pyridinium, N-octyl-3-methyl pyridinium, N-decyl-3-methyl pyridinium, N-methyl-4-methyl pyridinium, N-ethyl-4-methyl pyridinium, N-butyl-4-methyl pyridinium, N-hexyl-4-methyl pyridinium, N-octyl-4-methyl pyridinium, N-decyl-4-methyl pyridinium, N-methyl-3,4-dimethyl pyridinium, N-ethyl-3,4-dimethyl pyridinium, N-butyl-3,4-dimethyl pyridinium, N-hexyl-3,4-dimethyl pyridinium, N-octyl-3,4-dimethyl pyridinium, N-decyl-3,4-dimethyl pyridinium, N-methyl-3,5-dimethyl pyridinium, N-ethyl-3,5-dimethyl pyridinium, N-butyl-3,5-dimethyl pyridinium, N-hexyl-3,5-dimethyl pyridinium, N-octyl-3,5-dimethyl pyridinium, and N-decyl-3,5-dimethyl pyridinium.

(8)

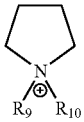

In formula (8), $R_9$ and $R_{10}$ each independently represent hydrogen or a hydrocarbon group having 1 to 10 carbon atoms, and may contain a hetero atom. Specific examples of the ion represented by formula (8) include the following: 1,1-dimethylpyrrolidinium, 1-ethyl-1-methylpyrrolidinium, 1-butyl-1-methylpyrrolidinium, 1-hexyl-1-methylpyrrolidinium, 1-octyl-1-methylpyrrolidinium, 1-decyl-1-methylpyrrolidinium, 1,1-diethylpyrrolidinium, 1-butyl-1-ethylpyrrolidinium, 1-hexyl-1-ethylpyrrolidinium, 1-octyl-1-ethylpyrrolidinium, 1-decyl-1-ethylpyrrolidinium, and 1,1-dibutylpyrrolidinium.

(9)

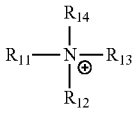

In formula (9), $R_{11}$, $R_{12}$, $R_{13}$ and $R_{14}$ each independently represent a hydrocarbon group having 1 to 10 carbon atoms, and may contain a hetero atom. Specific examples of the ion represented by formula (9) include the following: Tributyl methyl ammonium, tetraethyl ammonium, tetrabutyl ammonium, methyl trioctyl ammonium, tetraoctyl ammonium, tetraethyl ammonium, tetraheptyl ammonium, tetrapentyl ammonium, and tetrahexyl ammonium.

(10)

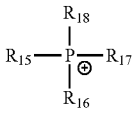

In formula (10), $R_{15}$, $R_{16}$, $R_{17}$ and $R_{18}$ each independently represent a hydrocarbon group having 1 to 10 carbon atoms, and may contain a hetero atom. Specific examples of the ion represented by formula (10) include the following: Tetrabutylphosphonium, trimethylhexylphosphonium, triethylpentylphosphonium, triethyloctylphosphonium, tributylmethylphosphonium, and tributyloctylphosphonium. It is noted that the counter ions represented by formulas (1) to (10) may be used in a combination of a plurality of species.

Since the counter ions represented by formulas (1) to (10) have high affinity with the above-described resin material, these ions are homogeneously dispersed in the resin material, and consequently, are suitably used also from the viewpoint of further reducing the non-uniformity in the electrical resistance value caused by the non-uniform dispersion. Moreover, since the counter ions represented by formulas (1) to (10) have properties of an ionic liquid, these ions can be present as a liquid and move within the resin material even in a state where the amount of water is small. In other words, these ions are suitably used also from the viewpoint that the lowering of the electrical resistance value under a low humidity environment can be improved. Here, the ionic liquid refers to a molten salt having a melting point of 100° C. or less.

Among the counter ions represented by formulas (1) to (10), the ions represented by formulas (1), (2), (6), (7) and (8) are particularly suitably used. This is because these counter ions have an extremely large size. As a result, the moving speed of these ions does not become excessively faster than necessary. Further, these counter ions represented by formulas (1), (2), (6), (7) and (8) have a structure which does not easily entangle in a molecular chain of the resin material as compared with the other counter ions having a larger size represented by formulas (9) and (10), and hence the resistance to the movement is small. Owing to this, the increase in the electrical resistance value can be suppressed.

The presence of the counter ions represented by formulas (1) to (10) can be verified by ion extraction using an ion exchange reaction. The electroconductive fiber stripped off from the surface layer of the electroconductive member is stirred in a dilute aqueous solution of hydrochloric acid or sodium hydroxide, so as to extract the counter ion contained in the electroconductive fiber into the aqueous solution. When the aqueous solution is dried after the extraction to collect an extract and the extract is subjected to mass spectrometric analysis by using a time-of-flight mass spectrometer (TOF-MS), the counter ion can be identified. The counter ion contained in the extract is a cation or an anion, and hence, even if the ion mass is large, the ion can be analyzed by the TOF-MS measurement without decomposing the ion. Furthermore, when the extract is subjected to elemental analysis by inductively coupled plasma (ICP) spectroscopy and the obtained result is combined with the result of the mass spectroscopy, the counter ion can be more easily identified.

As long as the effects of the present invention are not impaired, a filler, a softener, a processing aid, a tackifier, an anti-adhesion agent, a dispersant or the like generally used as a compounding agent for a resin can be added to the electroconductive fiber.

The electric characteristic, in terms of volume resistivity, of the surface layer having the network structure formed by the electroconductive fiber can be $1\times10^1$ Ωcm or more and $1\times10^8$ Ωcm or less. If the volume resistivity of the surface layer is $1\times10^8$ Ωcm or less, the increase of the electrical resistance value of the electroconductive member can be suppressed even when the network structure is made bulky.

When the network structure can be made bulky, the performance of inhibiting the abnormal discharge can be advantageously improved. If the volume resistivity of the surface layer is $1\times10^{1}$ Ωcm or more, an excessive discharge from the network structure can be suppressed, so as to inhibit the occurrence of a blank spot in an image.

The volume resistivity of the electroconductive fiber forming the surface layer having the network structure can be measured as follows: First, the surface layer having the network structure is collected with tweezers or the like from the electroconductive support layer. Subsequently, a single piece of fiber is brought into contact with a cantilever of a scanning probe microscope (SPM), and the volume resistivity can be measured with the single piece of fiber sandwiched between the cantilever and an electroconductive substrate. Alternatively, the surface layer having the network structure is similarly collected from the electroconductive support layer, the surface layer is molten by heating or by using a solvent to be formed into a sheet shape, and the volume resistivity of the sheet can be measured.

[Shape of Fiber]

The electroconductive fiber forming the network structure of the surface layer of the present invention has a length larger than the fiber diameter by 100 or more times. The fiber diameter and the fiber length can be verified by observing the network structure of the surface layer with an optical microscope or the like. The cross sectional shape of the fiber is not especially limited, and can be a circular, elliptical, square, polygonal, semicircular or an arbitrary cross sectional shape. Incidentally, the fiber diameter used herein means, if the cross sectional shape of the fiber is a circle, the diameter of the circle, and if the cross sectional shape of the fiber is not a circle, the length of the longest straight line passing through the center of gravity of the cross section.

[Fiber Diameter]

The electroconductive fiber forming the network structure of the surface layer of the present invention has an arithmetic mean value $d^{U10}$ of top 10% fiber diameters of 0.2 μm or more and 15.0 μm or less. If the arithmetic mean value $d^{U10}$ is 15.0 μm or less, the occurrence of image unevenness due to insufficient charging derived from the fibers can be inhibited. Alternatively, if the arithmetic mean value $d^{U10}$ is 0.2 μm or more, the abnormal discharge having an excessive discharge charge amount can be divided into uniform weak discharges. In order to increase the effect of inhibiting the image unevenness derived from the fiber and inhibiting the abnormal discharge having an excessive discharge charge amount in a well-balanced manner, the arithmetic mean value $d^{U10}$ can be 0.5 μm or more and 2 μm or less.

The arithmetic mean value "$d^{U10}$" refers to a fiber diameter which can be determined by the following method. First, a scanning electron microscope (SEM) is used for observing the surface layer of the electroconductive member from a direction facing the surface thereof, and fiber diameters are measured at arbitrary 100 points in an SEM-observed image. Subsequently, from the thus measured fiber diameters at the 100 points, fiber diameters at 10 points corresponding to top 10% of larger fiber diameters are selected, and a mean value of the selected diameters is calculated.

The fiber diameter may be measured at arbitrary points in the SEM-observed image, and in order to avoid bias in the measurement points, for example, with the SEM-observed image divided vertically into equal 5 to 20 regions and horizontally into equal 20 to 5 regions, one point of the fiber having a substantially circular cross section is arbitrarily selected in each of 100 divided regions thus obtained, so as to measure the fiber diameter in the selected point.

[Network Density of Surface Layer]

In the surface layer of the electroconductive member of the present invention, it is necessary that, when the surface layer is observed in such a manner as to face the layer, the number of crossings of the electroconductive fibers (hereinafter sometimes referred to as the "network density") observed in a square region having a one side length of 1.0 mm on the surface (the xy plane) of the surface layer should be one or more. The number of crossings of the electroconductive fibers in the surface layer can be observed from the direction (the z-axis direction) vertical to the surface of the surface layer by using an optical microscope, a laser microscope or the like. The observation is performed in arbitrary 100 square regions having each a one side length of 1.0 mm on the xy plane. The present inventors have confirmed that a giant discharge can be divided and subdivided if one or more crossings of the electroconductive fibers can be found in each of all the 100 square regions. Although an observed image includes information resulting from integrating all pieces of information along the thickness direction (the z-axis direction) of the surface layer, the subdivision of a discharge size is affected by a distance between meshes of the network structure including the information along the layer thickness direction, and consequently, this determination method of the present invention is regarded as suitable.

From the viewpoint of subdividing the abnormal discharge having an excessive discharge charge amount, the network density is 1 (mesh/$mm^2$) or more. Also, from the viewpoint of inhibiting the horizontal streak-like image failure under the L/L environment, a mean value of the network densities in the 100 points can be 100 (meshes/$mm^2$) or more.

Although the measurement points for the network density are arbitrarily determined, in order to avoid bias in the measurement points, for example, with the surface layer of the electroconductive member divided in the lengthwise direction into equal 5 to 25 regions and in the circumferential direction into equal 20 to 4 regions, an arbitrary one point in each of 100 divided regions thus obtained (namely, 100 points in total) may be selected as the measurement point.

[Three-Dimensional Structure of Surface Layer]

In the surface layer of the electroconductive member of the present invention, it is considered that the fiber is three-dimensionally arranged to provide a structure with an extremely large porosity. It is also considered that a state in which a space within the surface layer is partitioned by a fiber group is important for the exhibition of the effect of subdividing the abnormal discharge having an excessive discharge charge amount as above and the effect of inhibiting development of a weak discharge. Accordingly, it is preferred to quantitatively determine the fiber group present in the surface layer and the divided space within the surface layer formed by the fiber group.

The present inventors have defined the structure of the surface layer as described below from the viewpoints of the fibers and spaces occupied by the fibers. First, the surface layer is cut out from the electroconductive member, and a cross-sectional image of the cross section (either the yz cross section or the xz cross section) of the surface layer is obtained with X-ray CT. The thus obtained cross-sectional image is binarized to extract a cross-sectional image of the fibers, and a fiber cross-sectional image group in the cross-sectional image is subjected to the Voronoi tessellation, so as to define spaces within the surface layer occupied by each cross section of the fibers.

Here, the Voronoi tessellation is to classify a plurality of points (generating points) placed at arbitrary positions on a plane into regions depending on which one of the generating points any other point on the same metric space is close to. In particular, in the case of a two-dimensional Euclidean plane, the Voronoi tessellation is an approach involving drawing a perpendicular bisector on a straight line connecting the centers of gravity of generating points adjacent to each other and dividing the nearest region of each fiber with the perpendicular bisector. In addition, the nearest region of each generating point obtained by performing the Voronoi tessellation is called a Voronoi polygon. It is because the perpendicular bisector of the respective generating points adjacent to each other is unambiguously determined and hence the Voronoi polygon is also unambiguously determined that the Voronoi tessellation is employed.

Figure 7:
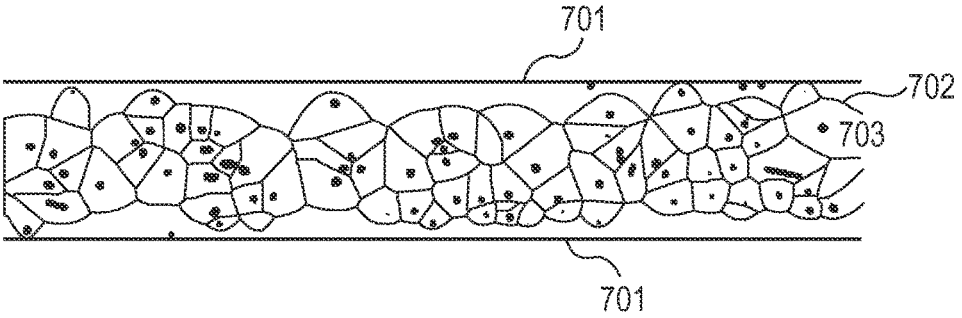
FIG. 7 is a diagram of an example of an image of the cross section of the fibers resulting from a Voronoi tessellation.

The present inventors have actually performed the Voronoi tessellation as follows: The outline is illustrated in FIG. 7. First, two straight lines 701, which are perpendicular to the z-axis, are included in two intersection lines between two planes passing through centers of gravity of fiber cross sections disposed at the uppermost end and the lowermost end in the fiber cross-sectional (yz cross sectional) image and the fiber cross section (the yz cross section), and have a length the same as the width of the fiber cross-sectional image, were drawn to be included in the fiber cross-sectional image. Here, the uppermost end and the lowermost end in the fiber cross-sectional image are as follows: in the cross-sectional image obtained before cutting out only the fiber cross-sectional image, a fiber cross-section whose shortest distance from the electroconductive support layer is largest in the fiber cross-sectional image group is defined as the uppermost end, and a fiber cross-section whose shortest distance is smallest was defined as the lowermost end. Then, these two straight lines were defined as "boundaries of an occupied region of the surface layer", and a rectangle formed by linking, with straight lines, the ends on the same side of the two straight lines to each other was defined as "the occupied region of the surface layer". Next, the Voronoi tessellation 702 was performed in this occupied region by using the fiber cross-sections as generating points. Such procedures were employed for the following reason: Fiber cross sections disposed in the uppermost position and the lowermost position in the cross-sectional image can define a region dividing line against adjacent fibers along a direction parallel to the surface of the electroconductive member (i.e., the y-axis direction), but along a direction vertical to the surface of the electroconductive member (i.e., the z-axis direction), cannot form a region dividing line because the number of generating points 703 is insufficient in this direction. In addition, also in the case where the surface layer has a small thickness, a state where a plurality of fiber cross sections are present in the direction vertical to the surface of the electroconductive member in the cross-sectional image cannot be established, and hence, a Voronoi polygon cannot be disadvantageously defined similarly in this case.

As a result of earnest studies made by the present inventors, it has been found that it is important to optimize a ratio "$S_1/S_2$" (hereinafter sometimes referred to as the "area ratio k"), wherein each of areas of Voronoi polygons in the yz cross section resulting from the aforementioned method is defined as $S_1$, and wherein each of cross-sectional areas in the cross section of the electroconductive fibers as the generating points of the respective Voronoi polygons is defined as $S_2$. In the present invention, the arithmetic mean value $k^{U10}$ of top 10% area ratios k can be 40 or more and 160 or less. Specifically, if the arithmetic mean value $k^{U10}$ is 160 or less, the Voronoi polygons can be prevented from becoming too large against the respective fiber in the surface layer to increase the subdividing effect, and hence, the abnormal discharge and the weak discharge can be inhibited. On the other hand, if the arithmetic mean value $k^{U10}$ is 40 or more, the Voronoi polygons can be prevented from becoming too small against the respective fiber in the surface layer, and hence, the porosity becomes appropriate. Accordingly, occurrence of a portion that cannot be sufficiently charged on the surface of a photosensitive drum can be avoided, and an image failure hardly occurs. From the viewpoint of the inhibition of the abnormal discharge and sufficient charging of a photosensitive drum, the arithmetic mean value $k^{U10}$ is more preferably 60 or more and 120 or less.

[Thickness of Surface Layer]

As described above, in order to exhibit the effect of inhibiting the abnormal discharge, it is important that the surface layer having the network structure is present in a discharge space between the electroconductive member and the photosensitive drum. Since the abnormal discharge is caused in the direction vertical to the surface of the electroconductive member, the thickness of the surface layer having the network structure is important, and the surface layer has preferably an average thickness $t_s$ of 10 μm or more and 400 μm or less. If the average thickness is 10 μm or more, an effect of further subdividing and further stabilizing the discharge can be attained. On the other hand, if the average thickness is 400 μm or less, a charge failure caused by insulation of the electroconductive member can be prevented.

In the present invention, in order that a stable discharging characteristic can be retained even if the surface layer having the network structure formed by the electroconductive fiber is worn away or worn out due to a long-term use, the average thickness of the surface layer is preferably 50 μm or more and 400 μm or less.

The "thickness of the surface layer" means a length, in the vertical direction to the surface (the z-axis direction), from the surface of the electroconductive support layer to the position where the electroconductive fiber forming the surface layer having the network structure is present. The "average thickness" means a mean value of measured values of the thickness of the surface layer measured at arbitrary 10 points. This average thickness can be determined by cutting out, from the electroconductive member, a segment including the electroconductive support layer and the network structure to be subjected to measurement by the X-ray CT.

Although the measurement points for the thickness of the surface layer are arbitrarily determined, in order to avoid bias in the measurement points, for example, with the surface layer of the electroconductive member divided in the lengthwise direction into equal 10 regions, an arbitrary one point in each of the 10 regions thus obtained (10 points in total) may be selected as the measurement point.

[Method for Forming Surface Layer]

A method for forming the surface layer having the network structure of the present invention is not especially limited, and for example, the following method can be employed: A raw material is formed into a shape of fiber by an electrospinning method (an electric field spinning method, an electrostatic spinning method), a conjugate fiber spinning method, a polymer blend spinning method, a melt-blow spinning method, a flash spinning method or the like, and the resulting fiber is laminated on the electroconductive support layer. All fiber-shaped products obtained by the aforementioned methods have a sufficient length as compared with the fiber diameters.

The electrospinning method is a method for producing fiber in which a high voltage is applied between a material solution put in a syringe and a collector electrode, so that the solution extruded from the syringe can be charged and scattered in the electric field to be thinned into the shape of fiber and adhered to the collector. Among the aforementioned methods for producing fine fiber, the electrospinning method is preferred.

Figure 3:
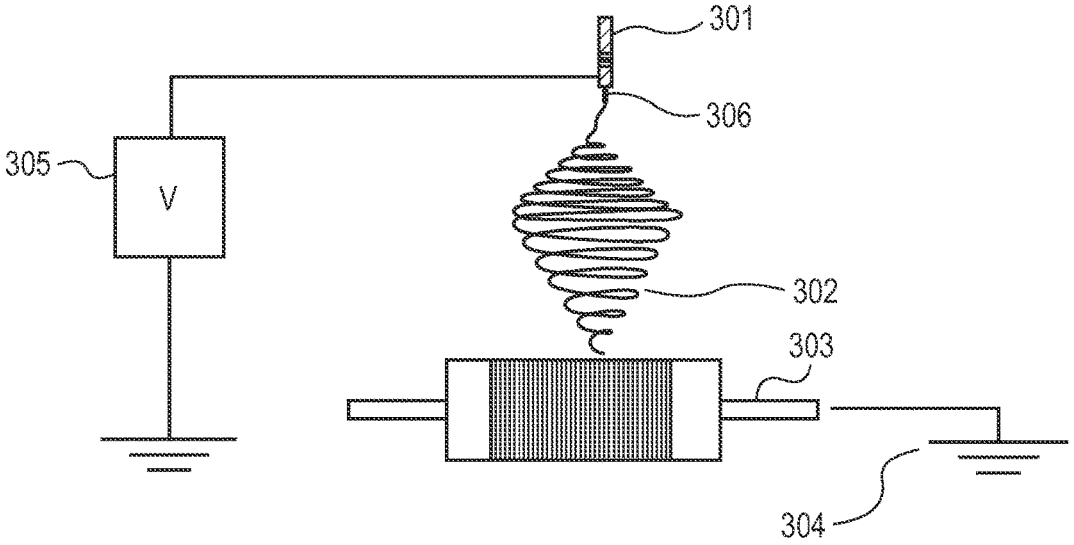
FIG. 3 is a schematic diagram of an apparatus used for performing an electrospinning method.

A method for producing the network structure by the electrospinning method will be described with reference to FIG. 3. The electrospinning method is performed by using a high voltage power source 305, a storage tank 301 for a material solution, a spinning nozzle 306, and a collector 303 connected to ground 304. The material solution is extruded from the tank 301 to the spinning nozzle 306 at a constant speed. A voltage of 1 to 50 kV is applied to the spinning nozzle 306, and when the electrical attraction exceeds the surface tension of the material solution, a jet 302 of the material solution is ejected toward the collector 303. At this time, a solvent contained in the jet is gradually evaporated, and when the jet reaches the collector, the size of the jet 302 is reduced to nano size. A method for preparing the material solution is not especially limited, and any of conventional methods can be appropriately employed. The type of the solvent and the concentration of the solution are not especially limited, and can be set to meet optimum conditions for the electrospinning. Alternatively, instead of the material solution, a molten material heated to a temperature equal to or higher than the melting point can be used.

The network structure used in the present invention can be obtained by controlling the fiber diameter of the fiber forming the network structure, and the network density and the thickness of the network structure. The fiber diameter of the fiber, and the network density and the thickness of the network structure can be controlled as follows.

First, the fiber diameter of the fiber can be controlled mainly through the solid content concentration of the material, and the fiber diameter can be reduced by lowering the solid content concentration. As another means, the fiber diameter can be reduced by increasing the voltage applied in spinning or by reducing the volume of the jet 302 to increase the electrical attraction. Further, the network density can be controlled mainly by virtue of the applied voltage. Specifically, when the applied voltage is increased, the electrical attraction can be increased to increase the density. Other than the applied voltage, the density can be increased by elongating the spinning duration time or increasing the ejecting speed. Furthermore, the thickness of the network structure is in proportion to the spinning duration. Accordingly, the thickness of the network structure can be increased by elongating the spinning duration.

In the present invention, the electroconductive member in which the layer of the network structure is coated on the circumference of the electroconductive support layer can be directly produced by using the electroconductive support layer as the collector. In this case, the layer of the network structure is seamless. Incidentally, in some methods for forming the layer of the network structure, there is a possibility that a seam may be formed. For example, in a method in which a film of the network structure is formed once and then the electroconductive support layer is coated with this film, a seam is formed in the layer of the network structure. Since the seam portion has a larger thickness than the other portions, an image failure can be caused in the seam portion in some cases. Accordingly, the layer of the network structure is preferably seamless.

The electroconductive support layer and the surface layer having the network structure can be directly laminated to each other, or can be laminated and bonded to each other by using a bonding agent (a pressure sensitive adhesive), and any of conventional methods can be appropriately employed. If these layers are laminated and bonded to each other by using a bonding agent, adhesion between the electroconductive support layer and the surface layer having the network structure can be easily improved, resulting in an electroconductive member with higher durability.

<Rigid Structural Body>

The effects of the present invention are exhibited owing to the presence of the surface layer having the network structure according to the present invention. In other words, if the structure of the network structure is changed, there is a possibility that the discharge characteristic may be also changed. Accordingly, particularly for the purpose of long-term use, if a rigid structural body for protecting the network structure of the surface layer is introduced, friction and abrasion between the surface of a photosensitive drum and the network structure of the surface layer can be reduced to inhibit the structural change in the network structure. Here, the "rigid structural body" refers to a structural body whose deformation volume caused through its contact with the photosensitive drum is 1 μm or less.

A method for providing the rigid structural body is not limited as long as the effects of the present invention are not impaired, and for example, a separation member is introduced into the electroconductive member. The separation member is not limited as long as the photosensitive drum and the surface layer having the network structure can be separated from each other and the effects of the present invention are not impaired, and examples of the separation member include a ring and a spacer.

As an example of the method for introducing the separation member, if the electroconductive member is in a roller shape, a ring that has a larger outer diameter than the electroconductive member and has sufficient hardness for holding a gap between the photosensitive drum and the surface layer having the network structure is introduced. As another example of the method for introducing the separation member, if the electroconductive member is in a blade shape, a spacer capable of separating the surface layer having the network structure and the photosensitive drum from each other is introduced so as to avoid the friction and abrasion therebetween.

A material for the separation member is not limited as long as the effects of the present invention are not impaired, and any of known non-conductive materials can be appropriately used for preventing an electric current from flowing through the separation member. Examples of the material include a polymer material having a good sliding property, such as a polyacetal resin, a high molecular weight polyethylene resin or a nylon resin, and a metal oxide material such as titanium oxide or aluminum oxide.

<Process Cartridge>

Figure 4:
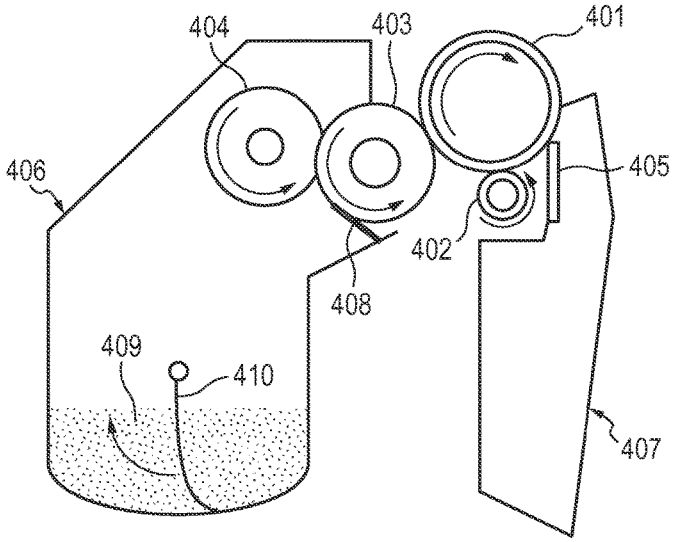
FIG. 4 is a schematic diagram of a process cartridge using the electroconductive member of the present invention.

FIG. 4 is a schematic diagram of a process cartridge using the electroconductive member of the present invention as a charging roller and the like. This process cartridge is realized by integrating a developing unit and a charging unit necessary for image formation, and is designed to be detachably mountable to a main body of an electrophotographic apparatus. The developing unit includes a developing roller 403 for developing a toner image on an electrophotographic photosensitive member, an RS roller 404 for supplying a toner to the developing roller, and a developing blade 408 for uniformly regulating the toner on the developing roller. The developing unit further includes a toner 409, an impeller 410 for stirring the toner, and a toner container 406 for storing the toner. The charging unit includes a charging roller 402 for charging the electrophotographic photosensitive member 401, a cleaning blade 405 for removing the toner remaining on the electrophotographic photosensitive member 401, and a waste toner container 407 for storing a collected toner or the like.

<Electrophotographic Apparatus>

Figure 5:
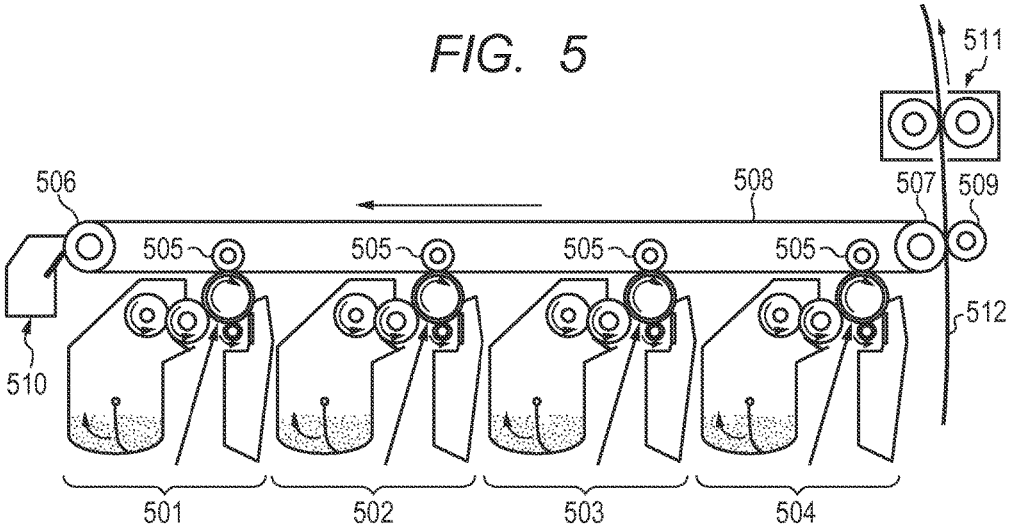
FIG. 5 is a schematic diagram of an electrophotographic image forming apparatus using the electroconductive member of the present invention.

FIG. 5 is a schematic diagram of an electrophotographic apparatus using the electroconductive member of the present invention as a charging roller and the like. This electrophotographic apparatus includes process cartridges 501 to 504 for four colors, primary transfer rollers 505 each for transferring a toner image formed on a photosensitive member onto an intermediate transfer belt 508, a secondary transfer roller 509 for transferring the toner image onto a transfer material 512, a fixing unit 511 for fixing the toner image, and the like.

The toner image developed by each of the process cartridges 501 to 504 is transferred by each of the primary transfer rollers 505 onto the intermediate transfer belt 508 supported and driven by a tension roller 506 and an intermediate belt drive roller 507. The toner image transferred onto the intermediate transfer belt 508 is further transferred by the secondary transfer roller 509 onto the transfer material 512 such as plain paper. It is noted that the transfer material 512 is conveyed by a paper feed system (not shown) including a conveyance member. The fixing unit 511 is constituted of a heated roll and the like, so as to fix the transferred toner image on the transfer material 512 and eject the resultant to the outside of the apparatus. The toner not transferred but remaining on the intermediate transfer belt is scraped off by a cleaning unit (an intermediate transfer belt cleaner) 510.

EXAMPLES

The present invention will now be more specifically described with reference to examples.

First, methods for preparing coating liquids 1 to 19 to be used for forming the network structure (the surface layer) will be described in the following preparation examples 1 to 19.

Preparation Examples

Preparation Example 1: Preparation of Coating Liquid 1

Deionized water was added to 5 g of polyethylene oxide (molecular weight: 900,000) to adjust the viscosity of the resultant to 300 mPa·s. In addition, 2 parts by mass of tetramethylammonium chloride was added as an ion conducting agent to 100 parts by mass of the resulting polyethylene oxide, followed by stirring. Thus, a coating liquid 1 was prepared.

Preparation Example 2: Preparation of Coating Liquid 2

Deionized water was added to 20 g of a diallyldimethylammonium chloride copolymer aqueous solution (trade name: PAS-H10L, manufactured by Nittobo Medical Co., Ltd., having a concentration of 28%; to adjust the viscosity of the resultant to 300 mPa·s, and thus, a coating liquid 2 was prepared.

Preparation Example 3: Preparation of Coating Liquid 3

Deionized water was added to 25 g of a sodium polystyrene sulfonate aqueous solution (trade name: Poly-NaSS PS-100, manufactured by Tosoh Organic Chemical Co., Ltd., having a concentration of 21%) to adjust the viscosity of the resultant to 300 mPa·s, and thus, a coating liquid 3 was prepared.

Preparation Example 4: Preparation of Coating Liquid 4

Twenty (20) g of a diallyldimethylammonium chloride copolymer aqueous solution (trade name: PAS-H10L, manufactured by Nittobo Medical Co., Ltd., having a concentration of 28%) and 15 g of lithium cyclohexafluoropropane-1,3-bis(sulfonyl)imide were prepared. These two materials were mixed so as to exchange the chloride ion of diallyldimethylammonium chloride with the cyclohexafluoropropane-1,3-bis(sulfonyl)imide ion. Deionized water was further added thereto to adjust the viscosity of the resultant to 300 mPa·s, and thus, a coating liquid 4 was prepared.

Preparation Examples 5 to 10

Preparation of Coating Liquids 5 to 10

In the same manner as in Preparation Example 4 except that the lithium cyclohexafluoropropane-1,3-bis(sulfonyl) imide was replaced with each of the following compounds whose kinds and amounts are also shown below, the chloride ion of the diallyldimethylammonlum chloride was exchanged with an anion contained in each of the compounds used. Thus, coating liquids 5 to 10 were prepared.

Potassium bis(trifluoromethylsulfonyl)imide 15 g (Preparation Example 5)

Potassium bis(pentafluoroethylsulfonyl)imide 17 g (Preparation Example 6)

Potassium bis(nonafluorobutylsulfonyl)imide 27 g (Preparation Example 7)

Potassium hexafluorophosphate 9 g (Preparation Example 8)

Lithium tetrafluoroborate 5 g (Preparation Example 9)

Sodium butanesulfonate 7 g (Preparation Example 10)

TABLE 1

| Coating liquid No. | Counter ion |
|---|---|
| 1 | Chloride ion |
| 2 | Chloride ion |
| 3 | Hydrogen ion |
| 4 | Cyclohexafluoropropane-1,3-bis(sulfonyl)imide ion |
| 5 | Bis(trifluoromethylsulfonyl)imide ion |
| 6 | Bis(pentafluoroethylsulfonyl)imide ion |
| 7 | Bis(nonafluorobutanesulfonyl)imide ion |
| 8 | Hexafluorophosphate ion |
| 9 | Tetrafluoroborate ion |
| 10 | Butanesulfonate ion |

Preparation Example 11: Preparation of Coating Liquid 11

Twenty-five (25) g of a sodium polystyrene sulfonate aqueous solution (trade name: Poly-NaSS PS-100, manufactured by Tosoh Organic Chemical Co., Ltd., having a concentration of 21%) and 5 g of 1-ethyl-3-methylimidazolium chloride were prepared. These two materials were mixed so as to exchange the sodium ion of sodium polystyrene sulfonate with the 1-ethyl-3-methylimidazolium ion. Deionized water was further added thereto to adjust the viscosity of the resultant to 300 mPa·s, and thus, a coating liquid 11 was prepared.

Preparation Examples 12 to 18

Preparation of Coating Liquids 12 to 18

In the same manner as in Preparation Example 4 except that the 1-ethyl-3-methylimidazolium chloride was replaced with each of the following compounds whose kinds and amounts are shown below, the chloride ion of the diallyldimethylammonium chloride was exchanged with an anion contained in the corresponding compound. Thus, coating liquids 12 to 18 was prepared.

1-Hexyl-3-methylimidazolium chloride 7 g (Preparation Example 12)

1-Ethyl-2,3-dimethylimidazolium chloride 5 g (Preparation Example 13)

1-Ethyl-3-methylpyridinium chloride 5 g (Preparation Example 14)

1-Butyl-1-methylpyrrolidinium 5 g (Preparation Example 15)

Tetrabutyl ammonium 8 g (Preparation Example 16)

Methyl trioctyl ammonium 11 g (Preparation Example 17)

80% Aqueous solution of tetrabutylphosphonium 10 g (Preparation Example 18)

TABLE 2

| Coating liquid No. | Counter ion |
|---|---|
| 11 | 1-Ethyl-3-methylimidazolium ion |
| 12 | 1-Hexyl-3-methylimidazolium ion |
| 13 | 1-Ethyl-2,3-dimethylimidazolium ion |
| 14 | 1-Ethyl-3-methylpyridinum ion |
| 15 | 1-Butyl-1-methylpyrrolidinum ion |
| 16 | Tetrabutyl ammonium ion |
| 17 | Methyl trioctyl ammonium ion |
| 18 | Tetrabutylphosphonium ion |

Preparation Example 19

Deionized water was added to 5 g of a butyral resin aqueous solution (trade name: KW-1, manufactured by Sekisui Chemical Co., Ltd., having a concentration of 26.5%) to adjust the viscosity of the resultant to 300 mPa·s, and thus, a coating liquid 19 was prepared.

Example 1

1. Preparation of Unvulcanized Rubber Composition

Materials whose kinds and amounts are shown in Table 3 below were mixed by using a pressure kneader to obtain an A kneaded rubber composition. Furthermore, 166 parts by mass of the A kneaded rubber composition was mixed with materials whose kinds and amounts are also shown in Table 4 below by using an open roll, so as to prepare an unvulcanized rubber composition.

TABLE 3

| | Material | Content parts by mass |
|---|---|---|
| Raw rubber | NBR (trade name: Nipol DN219 manufactured by Zeon Corporation) | 100 |
| Conducting agent | Carbon black (trade name: Tokablack #7360SB manufactured by Tokai Calcium Co., Ltd.) | 40 |
| Filler | Calcium carbonate (trade name: Nanox #30 manufactured by Maruo Calcium Co., Ltd.) | 20 |
| Vulcanization acceleration assistant | Zinc oxide | 5 |
| Processing aid | Stearic acid | 1 |

TABLE 4

| | Material | Content parts by mass) |
|---|---|---|
| Crosslinking agent | Sulfur | 1.2 |
| Vulcanization acceleration assistant | Tetrabenzylthiuram disulfide (trade name: TBZTD manufactured by Sanshin Chemical Industry Co., Ltd.) | 4.5 |

2. Preparation of Electroconductive Support Layer

A round bar, having a length of 252 mm and an outer diameter of 6 mm, of free-cutting steel whose surface had been subjected to electroless nickel plating was prepared. Next, a roller coater was used for applying, as a bonding agent, Metaloc U-20 (trade name, manufactured by Toyokagaku Kenkyusho Co., Ltd.) over a whole circumferential surface portion with a length of 230 mm of the round bar excluding both end portions each having a length of 11 mm. In this example, the round bar thus coated with the bonding agent was used as a conductive mandrel.

Next, a die having an inner diameter of 12.5 mm was attached to a tip of a cross head extruder equipped with a mechanism for supplying the conductive mandrel and a mechanism for discharging an unvulcanized rubber roller, and the temperatures of the extruder and the cross head were set to 80° C. and the conveyance speed of the conductive mandrel was adjusted to 60 mm/sec. Under these conditions, the unvulcanized rubber composition was supplied from the extruder to cover the circumferential portion of the conductive mandrel with the unvulcanized rubber composition in the cross head, and thus, an unvulcanized rubber roller was obtained. Next, the unvulcanized rubber roller was put in a hot-air vulcanizing furnace at 170° C. for vulcanizing the rubber composition by heating for 60 minutes, and thus, a roller having an elastic layer on the circumferential portion of the mandrel was obtained. Thereafter, end portions of the elastic layer were removed by cutting off by 11 mm each, so that the elastic layer portion had a length in the lengthwise direction of 230 mm. Ultimately, the surface of the elastic layer was polished with a rotating grindstone. In this manner, an electroconductive elastic roller 1A having a diameter, as measured at positions away from the center portion toward both ends by 90 mm each, of 8.4 mm and a diameter at the center portion of 8.5 mm was obtained. In this example, this electroconductive elastic roller was used as an electroconductive support layer.

3. Production of Electroconductive Member

Next, the electrospinning method was performed for spraying the coating liquid 1, and the thus produced fine fiber was directly wound around the electroconductive support layer attached as the collector, so as to form a layer of a network structure on the outer circumference of the electroconductive support layer, and thus, an electroconductive member of the present invention was produced.

Specifically, first, the electroconductive elastic roller 1 was attached as a collector of an electrospinning apparatus (trade name: Nanon, manufactured by Mec Co., Ltd.). Next, the coating liquid 1 was filled in a tank. Then, under application of a voltage of 25 kV to a spinning nozzle, the coating liquid 1 was sprayed toward the electroconductive elastic roller 1A with the spinning nozzle laterally moved at 50 mm/sec. The amount of the coating liquid sprayed was set to 5 ml/h. At that time, the electroconductive elastic roller 1A as the collector was rotated at 1,000 rpm. By spraying the coating liquid 1 for 180 seconds, an electroconductive member 1 having a layer of a network structure was obtained.

4. Evaluation of Network Structure of Surface Layer

The electroconductive member 1 was evaluated for the network structure of the surface layer by the following methods. The evaluation results are shown in Table 6.

[4-1. Measurement of Arithmetic Mean Value $d^{U10}$]

For measuring fiber diameters of the fiber forming the network structure, a scanning electron microscope (SEM) (trade name: S-4800, manufactured by Hitachi High-Technologies Corporation) was used for observation at 2,000-fold magnification. The surface layer of the electroconductive member was observed with the SEM from a direction facing the surface thereof to obtain an SEM observed image. In each of 100 regions of the image obtained by dividing the SEM observed image vertically into 10 regions and horizontally into 10 regions, one point in focus of the fiber was selected to measure the fiber diameter. Subsequently, from the thus measured fiber diameters of 100 points, 10 fiber diameters corresponding to top 10% of larger fiber thicknesses were selected, and a mean value of the selected fiber diameters was calculated as an arithmetic mean value $d^{U10}$ of the top 10% fiber diameters.

[4-2. Measurement of Network Density of Surface Layer]

The electroconductive member 1 was observed in the following measurement points from a direction facing the surface layer (the z-axis direction) by using a laser microscope (trade name: LSM5•PASCAL, manufactured by Carl Zeiss AG). At that time, the surface layer was divided longitudinally (in the x-axis direction) into equal 25 regions and circumferentially into equal 4 regions, and an arbitrary one point in each of the thus obtained 100 regions was set as the measurement point. In each of these measurement points (100 points in total), a square region having a one side length of 1.0 mm on the surface (the xy plane) was observed to count the number of crossings of the fibers within the region. An arithmetic mean value of the numbers of the crossings in the 100 points was obtained and evaluated based on the following criteria:

Rank A: The number of crossings is 1 or more and less than 10.

Rank B: The number of crossings is 10 or more and less than 100.

Rank C: The number of crossings is 100 or more and less than 1,000.

Rank D: The number of crossings is 1,000 or more and less than 10,000.

Rank E: The number of crossings is 10,000 or more.

Rank F: Any of the regions has the number of crossings less than 1.

[4-3. Measurement of Area Ratios Obtained by Voronoi Tessellation]

First, the surface layer of the electroconductive member 1 was cut with a razor into a segment having dimensions in the x-axis direction and the y-axis direction of 250 μm for each and a thickness in the z-axis direction of 700 μm including the rubber roller corresponding to the electroconductive support layer. Next, the cut segment was subjected to three-dimensional reconstruction by using an X-ray CT imaging apparatus (trade name: TOHKEN-SkyScan 2011, manufactured by SkyScan) (using a radiation source TX-300, manufactured by Tohken Co., Ltd.). As the imaging conditions, the X-ray tube voltage was set to 20 kV, the focal spot size was set to 0.4 μm, and the sample was rotated by 360° in 8 seconds by 0.3° at a time. The thus obtained image had 1280×1024 pixels. From the resultant three-dimensional image, 20 two-dimensional slice images (parallel to the xy plane) were cut out at an interval of 1 μm against the z-axis.

Figure 6:
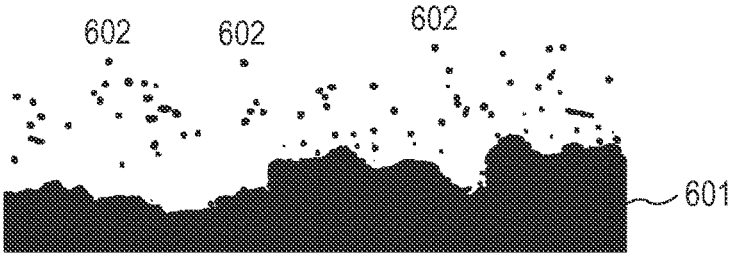
FIG. 6 is a diagram of an example of a binary image of a cross section of fibers forming a network structure of a surface layer.

Next, these slice images were subjected to the Voronoi tessellation. First, an image processing software "Imagepro-plus ver. 6.3" (manufactured by Media Cybernetics Inc.) was used to change the brightness and the contrast of each slice image, as long as the size of a fiber cross sectional image was not changed, and binarization was performed so that a fiber cross-sectional image group and the electroconductive support layer were shown in black. Thus, a binary image was obtained. An example of the actually obtained binary image is illustrated in FIG. 6, in which a reference numeral 601 denotes the electroconductive support layer and reference numerals 602 denote a fiber cross-sectional image group.

Next, only a cross-sectional image of the fiber was cut out from the binary image by using a paint application supplied with "Windows® 7" manufactured by Microsoft Corporation to obtain a fiber cross-sectional image. Further, a group of centers of gravity of fiber cross sections in the fiber cross-sectional (the yz cross-sectional) image was transferred to rectangular coordinates to obtain an approximation straight line of a distribution of the group of centers of gravity by a method of least squares. Then, two straight lines (in the y-axis direction) that were parallel to the approximation straight line, passed respectively through fiber cross sections disposed at the uppermost end and the lowermost end in the fiber cross-sectional image excluding the fiber cross sections present at the uppermost end and the lowermost end, and had a length of 1 mm, were drawn. Here, with respect to the uppermost end and the lowermost end in the fiber cross-sectional image, the fiber cross-section whose shortest distance from the electroconductive support layer is largest in the fiber cross-sectional image group is referred to as the uppermost end, and the fiber cross-section whose shortest distance is smallest is referred to as the lowermost end. Then, a rectangle formed by connecting the both ends of these two straight lines with straight lines was defined as an occupied region of the network structure.

Subsequently, the above-described image processing software was used for performing the Voronoi tessellation on the yz cross section in the occupied region by pruning processing using the group of fiber cross sections (on the yz cross section) as generating points. An example of a diagram resulting from the Voronoi tessellation is illustrated in FIG. 7. In FIG. 7, reference numerals 701 denote the two parallel straight lines used for defining the occupied region, a reference numeral 702 denotes a boundary of Voronoi polygons, and a reference numeral 703 denotes the group of fiber cross sections. Then, the area ratio k between the area $S_1$ of each of the thus obtained Voronoi polygons and the cross-sectional area $S_2$ in the cross section of the fiber as the generating point of each of the Voronoi polygons was calculated, and an arithmetic mean value $k^{L10}$ of top 10% of the area ratios k was obtained.

5. Image Evaluation

With the electroconductive member 1 incorporated as a charging member into an electrophotographic apparatus, image evaluation was performed by the following methods. The evaluation results are shown in Table 6.

[5-1. Evaluation of Horizontal Streak-Like Image Failure]

This evaluation was made for confirming the effect of the electroconductive member of stabilizing discharge.

As the electrophotographic apparatus, an electrophotographic laser printer (trade name: Laserjet CP4525dn manufactured by Hewlett-Packard Development Company, L.P.) was prepared. This apparatus was, however, modified so that the number of A4-size paper sheets to be output could be 50 sheets/min, namely, so that the sheet output speed could be 300 mm/sec. This laser printer had an image resolution of 1,200 dpi.

The electroconductive member 1 was incorporated as the charging member into a cartridge for the above-described laser printer, and the cartridge was attached to the laser printer. Then, the laser printer was used for outputting a half-tone image under the L/L environment (under an environment of a temperature of 15° C. and a relative humidity of 10%). The half-tone image used herein refers to an image in which lateral lines having a width of 1 dot and an interval of 2 dots are drawn along a direction vertical to the rotating direction of the photosensitive member. The thus obtained half-tone image was visually observed to be evaluated based on the following criteria:

Rank A: No horizontal streak-like image is formed.

Rank B: A slight horizontal streak-like white line is observed in a region smaller than 10% of a print area.

Rank C: A slight horizontal streak-like white line is observed in a region equal to or larger than 10% and smaller than 30% of the print area.

Rank D: A slight horizontal streak-like white line is observed in a region equal to or larger than 30% of the print area.

Rank E: A serious horizontal streak-like white line is observed and is conspicuous in a region equal to or larger than 30% of the print area.

[5-2. Evaluation of Blank Spot-Like Image Failure]

This evaluation was made for confirming the effect of the electroconductive member 1 of stabilizing discharge. In the same manner as in the evaluation of [5-1] described above, half-tone images were output to be visually observed and evaluated based on the following criteria:

Rank A: No image with a blank spot is observed in the image.

Rank B: A blank spot is observed in a region smaller than 1% of a print area.

Rank C: A blank spot is observed in a region equal to or larger than 1% and smaller than 3% of the print area.

Rank D: A blank spot is observed in a region equal to or larger than 3% of the print area.

[5-3. Evaluation of Solid White Image]

This evaluation was made for confirming the effect of the electroconductive member of stabilizing discharge.

The modified laser printer used in the evaluation of [5-1] described above was used.

The electroconductive member 1 was incorporated as the charging member into the cartridge for the above-described laser printer, and the cartridge was attached to the laser printer. The laser printer was used for outputting solid white images. At that time, the voltage applied to the charging member was changed.

Specifically, in this evaluation, the range of applied voltages $V_1$ within which practically non-problematic solid white images can be formed with charging members to be evaluated is measured. A standard applied voltage $V_0$ at which a practically non-problematic solid white image can be formed with a charging member not including the layer having the network structure of the present invention but including only the electroconductive support layer was assumed as "−1,100 V", and the performance of the electroconductive member 1 was evaluated based on a difference in the applied voltage represented by "$V_1$-$V_0$". The measurement was all performed under an environment of a temperature of 23° C. and a relative humidity of 50%, and the evaluation was made based on the following criteria. Here, it can be said that as a value of "$V_1$-$V_0$" is larger, the charging member to be evaluated has a larger range of the applied voltage within which a practically non-problematic solid white image can be formed, namely, has larger tolerance of the applied voltage.

Rank A: When $V_1$ is higher than $V_0$ by 75 V or more and less than 100 V, a practically non-problematic solid white image can be formed.

Rank B: When $V_1$ is higher than $V_0$ by 50 V or more and less than 75 V, a practically non-problematic solid white image can be formed.

Rank C: When $V_1$ is higher than $V_0$ by 25 V or more and less than 50 V, a practically non-problematic solid white image can be formed.

Rank D: When $V_1$ is higher than $V_0$ by less than 25 V, a practically non-problematic solid white image can be formed.

[5-4. Evaluation of Horizontal Streak-Like Image Failure Caused after Endurance Test]

Next, this evaluation was made for confirming that the electroconductive member of the present invention has the effect of inhibiting the occurrence of a horizontally streaky image even after outputting a large number of images.

The laser printer prepared in [5-1] above was used for outputting 10,000 electrophotographic images by repeating such an intermittent image formation operation that the rotation of the photosensitive drum was completely stopped for approximately 3 seconds after outputting 2 images and then the image output was resumed. The image output in this case was an image in which a 4-point size alphabet "E" was printed at a coverage of 4% in the whole area of an A4-size paper sheet (hereinafter also referred to as the "letter E image").

Then, after outputting 10,000 sheets of letter E images, one half-tone image was output, and this half-tone image was visually observed to be evaluated based on the following criteria. Incidentally, the images were output under the L/L environment in the same manner as in [5-1] above.

Rank A: No horizontal streak-like image is formed.

Rank B: A slight horizontal streak-like white line is observed in a region smaller than 10% of the print area.

Rank C: A slight horizontal streak-like white line is observed in a region equal to or larger than 10% and smaller than 30% of the print area.

Rank D: A slight horizontal streak-like white line is observed in a region equal to or larger than 30% of the print area.

Rank E: A serious horizontal streak-like white line is observed and is conspicuous in a region equal to or larger than 30% of the print area.

Examples 2 to 18

Electroconductive members 2 to 18 were produced and evaluated in the same manner as in Example 1 except that the coating liquid used for forming the network structure and the conditions for producing the electroconductive member were changed as shown in Table 5. The evaluation results are shown in Tables 6 and 7.

Example 19

An electroconductive member 19 was produced and evaluated in the same manner as in Example 1 except that a polyoxymethylene ring (a separation member) having an outer diameter of 8.6 mm, an inner diameter of 6.0 mm and a width of 2 mm was attached on the outside in the lengthwise direction of the elastic layer of Example 1 and adhered with a bonding agent so as to rotate together with the core bar. The evaluation results are shown in Tables 6 and 7. In this example, since the separation member was introduced, the separation member was in contact with the photosensitive drum to form a gap of approximately 50 μm on average between the electroconductive member and the photosensitive drum.

Comparative Examples 1 to 4

Electroconductive members C1 to C4 were produced and evaluated in the same manner as in Example 1 except that the coating liquid used for forming the network structure and the conditions for producing the electroconductive member were changed as shown in Table 5. The evaluation results are shown in Table 7.

TABLE 5

| | Coating liquid for surface layer | Applied voltage (kV) | Spray amount (ml/h) | Speed of lateral movement (mm/sec) | Rotational speed (rpm) |
|---|---|---|---|---|---|
| Example 1 | 1 | 25 | 5 | 50 | 1000 |
| Example 2 | 2 | 25 | 1 | 40 | 900 |
| Example 3 | 3 | 25 | 10 | 60 | 1500 |
| Example 4 | 4 | 25 | 1 | 60 | 1500 |
| Example 5 | 5 | 20 | 10 | 80 | 2000 |
| Example 6 | 6 | 25 | 1 | 50 | 1000 |
| Example 7 | 7 | 25 | 3 | 60 | 1500 |
| Example 8 | 8 | 25 | 0.5 | 80 | 2000 |
| Example 9 | 9 | 15 | 10 | 30 | 700 |
| Example 10 | 10 | 25 | 5 | 30 | 700 |
| Example 11 | 11 | 25 | 1 | 60 | 1500 |
| Example 12 | 12 | 25 | 5 | 50 | 1000 |
| Example 13 | 13 | 25 | 5 | 40 | 900 |
| Example 14 | 14 | 25 | 3 | 30 | 700 |
| Example 15 | 15 | 20 | 10 | 50 | 1000 |
| Example 16 | 16 | 25 | 3 | 50 | 1000 |
| Example 17 | 17 | 25 | 5 | 50 | 1000 |
| Example 18 | 18 | 25 | 5 | 80 | 2000 |
| Example 19 | 1 | 25 | 5 | 50 | 1000 |
| Comparative Example 1 | 19 | 15 | 10 | 30 | 700 |
| Comparative Example 2 | 19 | 25 | 5 | 20 | 500 |
| Comparative Example 3 | 19 | 25 | 0.1 | 80 | 2000 |
| Comparative Example 4 | 19 | 25 | 1 | 100 | 2200 |

TABLE 6

| Example | Chemical bond between resin and ion conducting agent | Counter | Structure of counter species | Fiber diameter $d^{U10}$ (μm) | Network density (meshes/mm$^2$) | Area ratio $k^{U10}$ (–) | Image failure with horizontal streak | Image failure with blank spot | Solid white image | Image failure with horizontal streak (after endurance) |
|---|---|---|---|---|---|---|---|---|---|---|
| Example 1 | Not bonded | Chloride | — | 1.2 | C | 88 | B | A | A | C |
| Example 2 | Bonded | Chloride | — | 0.6 | D | 61 | B | A | B | C |
| Example 3 | Bonded | Hydrogen | — | 1.8 | B | 118 | B | B | B | C |
| Example 4 | Bonded | Cyclohexafluoropropane-1,3-bis(sulfonyl)imide | Formula (1) | 0.6 | D | 116 | A | A | B | B |
| Example 5 | Bonded | Bis(trifluoromethylsulfonyl)imide | Formula (2) | 14.8 | A | 159 | A | C | C | B |
| Example 6 | Bonded | Bis(pentafluoroethylsulfonyl)imide | Formula (2) | 0.5 | D | 91 | A | A | B | B |
| Example 7 | Bonded | Bis(nonafluorobutanesulfonyl)imide | Formula (2) | 1.1 | C | 117 | A | A | B | B |
| Example 8 | Bonded | Hexafluorophosphate | Formula (3) | 0.3 | D | 158 | C | B | B | C |
| Example 9 | Bonded | Tetrafluoroborate | Formula (4) | 14.7 | B | 41 | B | C | C | C |
| Example 10 | Bonded | Butanesulfonate | Formula (5) | 1.8 | D | 13 | B | B | B | C |

Fiber diameter $d^{U10}$: Arithmetic mean value of top 10% fiber diameters,
Area ratio $k^{U10}$: Arithmetic mean value of top 10% area rations k

TABLE 7

| Example | Chemical bond between resin and ion conducting agent | Counter | Structure of counter species | Fiber diameter $d^{U10}$ (μm) | Network density (meshes/mm$^2$) | Area ratio $k^{U10}$ (–) | Image failure with horizontal streak | Image failure with blank spot | Solid white image | Image failure with horizontal streak (after endurance) |
|---|---|---|---|---|---|---|---|---|---|---|
| Example 11 | Not bonded | 1-Ethyl-3-methylimidazolium | Formula (6) | 0.6 | A | 118 | A | A | B | B |
| Example 12 | Bonded | 1-Hexyl-3-methylimidazolium | Formula (6) | 1.9 | A | 92 | A | A | B | B |
| Example 13 | Bonded | 1-Ethyl-2,3-dimethylimidazolium | Formula (6) | 0.9 | A | 63 | A | A | B | B |
| Example 14 | Bonded | 1-Ethyl-3-methylpyridinium | Formula (7) | 0.2 | B | 42 | B | B | B | C |
| Example 15 | Bonded | 1-Butyl-1-methylpyrrolidinium | Formula (8) | 14.9 | A | 87 | A | B | C | B |
| Example 16 | Bonded | Tetrabutyl ammonium | Formula (9) | 0.2 | C | 92 | C | A | B | C |
| Example 17 | Bonded | Methyl trioctyl ammonium | Formula (9) | 1.3 | B | 91 | B | A | B | C |
| Example 18 | Bonded | Tetrabutylphosphonium | Formula (10) | 1.9 | B | 159 | B | C | B | C |
| Example 19 | Not Bonded | Chloride | — | 1.2 | B | 88 | B | A | A | B |
| Comparative Example 1 | — | None | None | 22.0 | D | 41 | D | D | D | E |
| Comparative Example 2 | — | None | None | 1.8 | D | 18 | D | D | D | E |
| Comparative Example 3 | — | None | None | 0.1 | E | 158 | E | C | C | E |
| Comparative Example 4 | — | None | None | 0.5 | C | 181 | D | D | C | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-202661, filed Sep. 27, 2013, which is hereby incorporated by reference herein in its entirety.

What is claimed is:

1. A charging member for electrophotography comprising:

an electroconductive support layer; and a surface layer thereon, the surface layer having a network structure containing electroconductive fibers, wherein the electroconductive fibers have an ion conductivity, and an arithmetic mean value $d^{U10}$ of top 10% fiber diameters of 0.2 to 15.0 μm as measured at arbitrary 100 points in an SEM observed image of the electroconductive fibers, and (1) when the surface layer is observed in such a manner as to face the surface layer, one or more crossings of the electroconductive fibers are observed in a square region having a one side length of 1.0 mm on the surface of the surface layer; and (2) when a Voronoi tessellation is performed with generating points, the generating points being the electroconductive fibers exposed on a cross section in a thickness direction of the surface layer, an arithmetic mean value $k^{U10}$ of top 10% of the ratios $S_1/S_2$ is 40 to 160, where each of areas of Voronoi polygons resulting from the Voronoi tessellation is defined as $S_1$, and each of cross-sectional areas in the cross section of the electroconductive fibers as the generating points of the respective Voronoi polygons is defined as $S_2$.

2. The charging member for electrophotography according to claim 1, wherein the electroconductive fiber contains a resin and an ion conducting agent, and the ion conducting agent contains a quaternary ammonium group which is chemically bonded to the resin, and at least one ion species selected from the group consisting of formulae (1) to (5):

(1)

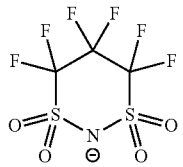

(2)

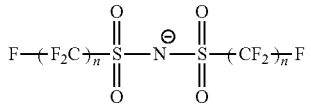

where n represents an integer of 1 to 4;

(3)

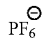

(4)

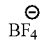

(5)

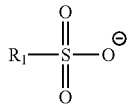

where $R_1$ represents a hydrocarbon group having 1 to 10 carbon atoms and may contain a hetero atom.

3. The charging member for electrophotography according to claim 1, wherein the electroconductive fiber contains a resin and an ion conducting agent, and the ion conducting agent contains a sulfonic acid group which is chemically bonded to the resin, and at least one ion species selected from the group consisting formulae (6) to (10):

(6)

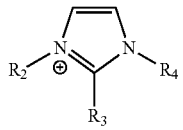

where $R_2$, $R_3$ and $R_4$ each independently represent hydrogen or a hydrocarbon group having 1 to 10 carbon atoms and may contain a hetero atom;

(7)

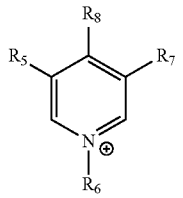

where $R_5$, $R_6$, $R_7$ and $R_8$ each independently represent hydrogen or a hydrocarbon group having 1 to 10 carbon atoms and may contain a hetero atom;

(8)

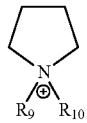

where $R_9$ and $R_{10}$ each independently represent hydrogen or a hydrocarbon group having 1 to 10 carbon atoms and may contain a hetero atom;

(9)

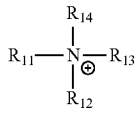

where $R_{11}$, $R_{12}$, $R_{13}$ and $R_{14}$ each independently represent a hydrocarbon group having 1 to 10 carbon atoms and may contain a hetero atom;

(10)

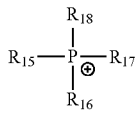

where $F_{15}$, $R_{16}$, $R_{17}$ and $R_{18}$ each independently represent a hydrocarbon group having 1 to 10 carbon atoms and may contain a hetero atom.

4. The charging member for electrophotography according to claim 1, further comprising a rigid structural body for protecting the surface layer having the network structure.

5. A process cartridge detachably mountable to a main body of an electrophotographic apparatus, the process cartridge comprising the charging member according to claim 1.

6. The process cartridge according to claim 5, wherein the process cartridge comprises:

an electrophotographic photosensitive member; and the charging member for charging the electrophotographic photosensitive member.

7. An electrophotographic apparatus comprising the charging member according to claim 1, and an electrophotographic photosensitive member.

8. The electrophotographic apparatus according to claim 7, wherein the electrophotographic apparatus comprises:

the electrophotographic photosensitive member; and the charging member for charging the electrophotographic photosensitive member.

9. The charging member for electrophotography according to claim 1, wherein the surface layer has a volume resistivity of $1\times10^1$ to $1\times10^8$ Ωcm.

10. The charging member for electrophotography according to claim 1, wherein the electroconductive fibers contain a resin and an ion conducting agent, and the ion conducting agent is chemically bonded to the resin.

* * * * *